US010014574B2

(12) United States Patent
Kobayashi et al.

(10) Patent No.: US 10,014,574 B2
(45) Date of Patent: Jul. 3, 2018

(54) ANTENNA DEVICE

(71) Applicant: Panasonic Intellectual Property Management Co., Ltd., Osaka (JP)

(72) Inventors: Yukari Kobayashi, Ishikawa (JP); Takenobu Arima, Kanagawa (JP); Hiroyuki Uejima, Ishikawa (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 269 days.

(21) Appl. No.: 14/935,525

(22) Filed: Nov. 9, 2015

(65) Prior Publication Data

US 2016/0156097 A1 Jun. 2, 2016

(30) Foreign Application Priority Data

Dec. 2, 2014 (JP) ..... 2014-243878

(51) Int. Cl.

| | |
|---|---|
| ***H01Q 1/48*** | (2006.01) |
| ***H01Q 1/27*** | (2006.01) |
| ***G04G 17/04*** | (2006.01) |
| ***G04G 21/04*** | (2013.01) |
| ***H01Q 9/40*** | (2006.01) |
| ***H01Q 9/42*** | (2006.01) |
| ***H01Q 5/371*** | (2015.01) |
| ***G04R 60/04*** | (2013.01) |

(52) U.S. Cl.

CPC ..... *H01Q 1/48* (2013.01); *G04G 17/04* (2013.01); *G04G 21/04* (2013.01); *G04R 60/04* (2013.01); *H01Q 1/273* (2013.01); *H01Q 5/371* (2015.01); *H01Q 9/40* (2013.01); *H01Q 9/42* (2013.01)

(58) Field of Classification Search

CPC ..... H01Q 1/48; H01Q 1/273; H01Q 5/307; H01Q 5/20

See application file for complete search history.

(56) References Cited

U.S. PATENT DOCUMENTS

2012/0076184 A1* 3/2012 Tran ..... H01Q 1/085 375/222
2014/0354494 A1* 12/2014 Katz ..... H01Q 1/273 343/718

FOREIGN PATENT DOCUMENTS

JP 2013-539322 10/2013
WO 2012/047722 4/2012

* cited by examiner

*Primary Examiner* — Andrea Lindgren Baltzell
(74) *Attorney, Agent, or Firm* — Seed IP Law Group LLP

(57) ABSTRACT

An antenna device includes a ground conductor; a ground conductor extension that is connected to the ground conductor; and an antenna element that is connected to the ground conductor and that operates in both a first frequency band and a second frequency band higher than the first frequency band, the ground conductor and the ground conductor extension having a length that is ¼ of a wavelength of a frequency included in a middle range between the first frequency band and the second frequency band and that is not a natural number multiple of ¼ of a wavelength of the first frequency band.

8 Claims, 3 Drawing Sheets

ANTENNA DEVICE

BACKGROUND

1. Technical Field

The present disclosure relates to an antenna device mounted in a wearable device or the like.

2. Description of the Related Art

In recent years, smart devices represented by smartphones are rapidly becoming widespread. As further development, small wearable devices are attracting attention. Devices having a near field wireless communication function such as wristwatch-type devices used in association with smartphones and terminals having a cellular communication function have been already commercialized.

A reduction in size of an antenna is essential for achievement of practical use of such a wearable device. However, the performance of an antenna is proportional to the working volume of the antenna. Accordingly, the performance of an antenna deteriorates as the whole size of the antenna becomes small.

In many cases, cellular communication of a mobile phone such as a smartphone supports multiband communication. In order to produce a multiband antenna device, it is general to employ an antenna configuration in which a feed system is an unbalanced type. The unbalanced-type feed system allows an antenna electric current to be also distributed in ground (GND) of a circuit board. This achieves a wider bandwidth and a higher gain while securing the working volume of the antenna.

However, in a case where a multiband antenna is employed in a small wearable device, the performance of the antenna deteriorates even by using the above configuration since the whole size of the antenna becomes small.

As a solution to this problem of a small antenna device, Japanese Unexamined Patent Application Publication (Translation of PCT Application) No. 2013-539322 discloses an antenna in which a GND enlarging unit is added to the antenna configuration using an unbalanced-type feed system and in which GND of a circuit board and the GND enlarging unit are designed to have a length that is proportional to approximately ¼ of the wavelength of frequencies in a plurality of frequency bands. This allows the working volume of the antenna to look large, thereby achieving a wider bandwidth and a higher gain.

In general, in the case of the antenna configuration using an unbalanced-type feed system, an antenna electric current also strongly flows in GND of a circuit board. This increases the electric current distribution density of GND of the circuit board. That is, a smaller device has a smaller circuit board and therefore has a higher electric current distribution density. As a result, an SAR (Specific Absorption Rate) value becomes higher.

However, the antenna disclosed in Japanese Unexamined Patent Application Publication (Translation of PCT Application) No. 2013-539322 is not designed in consideration of an SAR value although the size of the device is small.

SUMMARY

In one general aspect, the techniques disclosed here feature an antenna device including: a ground conductor; a ground conductor extension that is connected to the ground conductor; and an antenna element that is connected to the ground conductor and that operates in both a first frequency band and a second frequency band higher than the first frequency band, the ground conductor and the ground conductor extension having a length that is ¼ of a wavelength of a frequency included in a middle range between the first frequency band and the second frequency band and that is not a natural number multiple of ¼ of a wavelength of the first frequency band.

According to one aspect of the present disclosure, it is possible to provide an antenna device that has an antenna configuration in which a feed system is an unbalanced type and that takes into consideration an SAR characteristic while maintaining antenna performance.

Additional benefits and advantages of the disclosed embodiments will become apparent from the specification and drawings. The benefits and/or advantages may be individually obtained by the various embodiments and features of the specification and drawings, which need not all be provided in order to obtain one or more of such benefits and/or advantages.

DETAILED DESCRIPTION

Embodiments of the present disclosure are described in detail below with reference to the drawings. Note that the embodiments described below are examples, and the present disclosure is not limited by these embodiments.

Embodiment 1

Figure 1:
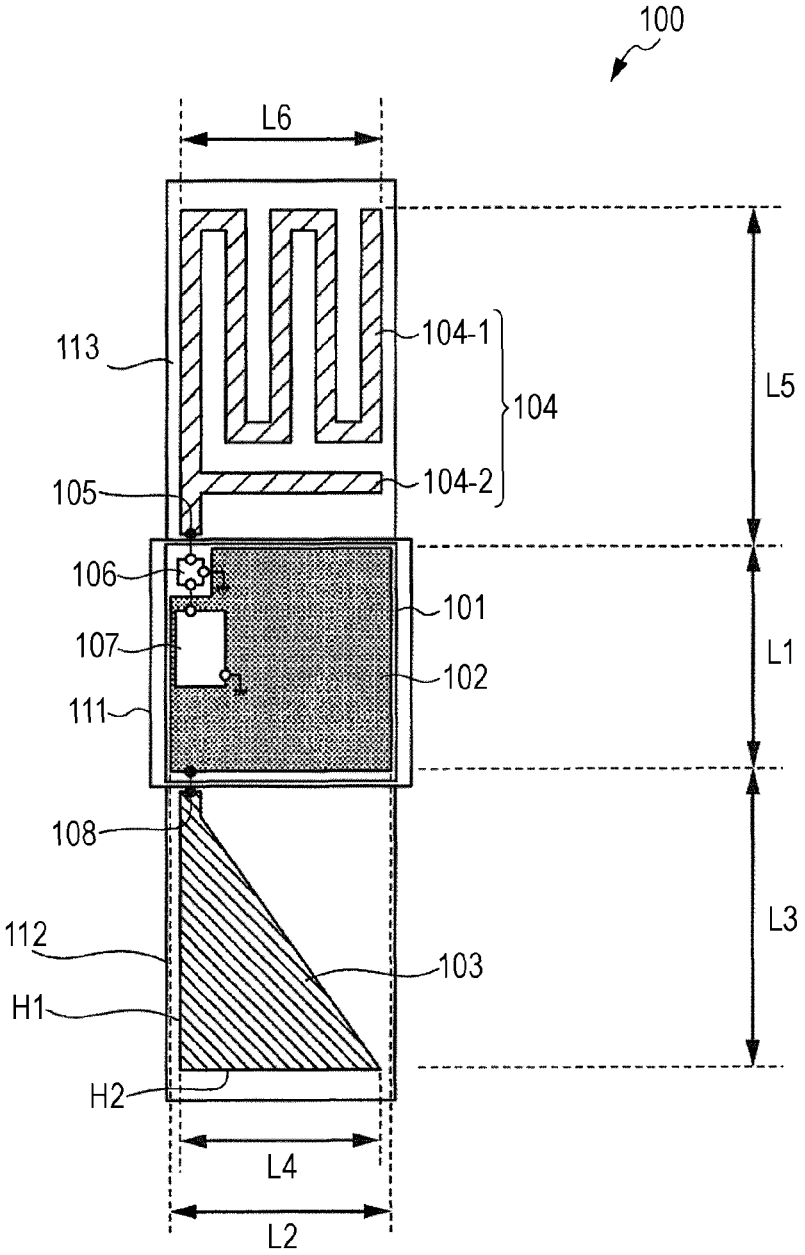
FIG. 1 is a diagram illustrating an example of a configuration of an antenna device according to Embodiment 1 of the present disclosure.

FIG. 1 is a diagram illustrating an example of a configuration of an antenna device 100 according to Embodiment 1 of the present disclosure. The antenna device 100 illustrated in FIG. 1 includes a circuit board 101, a ground conductor 102, a ground conductor extension unit 103, an antenna element 104, a feeding unit 105, a matching circuit unit 106, a wireless unit 107, and a connection unit 108. The antenna element 104 includes a first antenna element 104-1 and a second antenna element 104-2.

The antenna device 100 illustrated in FIG. 1 is constituted by a first portion 111, a second portion 112, and a third portion 113. Each of the three portion has a substantially rectangular shape. The second portion 112 is connected to one of opposing sides of the first portion 111 that are substantially parallel with each other, and the third portion 113 is connected to the other one of the opposing sides of the first portion 111.

The first portion 111 is, for example, made of a resin material such as ABS. The second portion 112 and the third portion 113 are, for example, made of a resin material such as rubber or plastic.

As illustrated in FIG. 1, the circuit board 101 is disposed in the first portion 111. The circuit board 101 is a printed board on which circuit parts for achieving various functions of a mobile terminal device are mounted. The circuit board 101 is, for example, made of a dielectric material and has a substantially rectangular parallelepiped shape.

As illustrated in FIG. 1, the ground conductor 102 is disposed on the circuit board 101. The ground conductor 102 has a potential such as a ground potential of the wireless unit 107 or the like. The ground conductor 102 has, for example, a substantially square shape whose longitudinal side has a length (L1) of approximately 20 mm and whose lateral side has a length (L2) of approximately 20 mm and is formed in a ground pattern made of a conductive material such as a copper foil. The "substantially square shape" as used herein refers to a shape such that the square is partially cut out and the length of a side of the cutout part is 20% or less of the length of a side of the square.

Note that although L1 and L2 are identical in this example, the present disclosure is not limited to this. The ground conductor 102 may have a substantially rectangular shape having L1 and L2 that are different from each other. The "substantially rectangular shape" as used herein refers to a shape such that the rectangle is partially cut out and the length of a side of the cutout part is 20% or less of the length of a longer side of the rectangle.

The ground conductor extension unit 103 is disposed in the second portion 112. The ground conductor extension unit 103 is grounded to the ground conductor 102 via the connection unit 108. The ground conductor extension unit 103 is made of a conductive material such as a copper foil. As illustrated in FIG. 1, the ground conductor extension unit 103 has, for example, a substantially triangular shape whose longer side H1 extending in a longitudinal direction of FIG. 1 has a length (L3) of 30 mm and whose shorter side H2 extending in the lateral direction of FIG. 1 has a length (L4) of 20 mm. The "substantially triangular shape" as used herein refers to a shape such that an interval between two sides extending from the shorter side H2 becomes smaller as the distance from the shorter side H2 becomes longer in FIG. 1. Note that how to design the ground conductor 102 and the ground conductor extension unit 103 will be described later.

The connection unit 108 is provided between the ground conductor 102 and the ground conductor extension unit 103. The connection unit 108 is provided at an apex of the ground conductor extension unit 103. The shorter side H2 of the ground conductor extension unit 103 is located on the side opposite to the apex at which the connection unit 108 is provided.

The wireless unit 107 is disposed on the ground conductor 102 and is grounded. The wireless unit 107 transmits and/or receives signal in a plurality of frequency bands and is connected to the matching circuit unit 106. In the following description, it is assumed that the plurality of frequency bands are a first frequency band and a second frequency band and that the second frequency band is a frequency band that is different from the first frequency band and is higher than the first frequency band. For example, the first frequency band is a 800 MHz band, and the second frequency band is a 2 GHz band.

As illustrated in FIG. 1, the matching circuit unit 106 is disposed on the circuit board 101 and is grounded to the ground conductor 102. The matching circuit unit 106 is connected to the wireless unit 107 and is connected to the antenna element 104 via the feeding unit 105. The matching circuit unit 106 has a function of matching the impedance of the antenna element 104 with the circuit impedance of the wireless unit 107. Note that the circuit impedance of the wireless unit 107 is generally approximately 50Ω.

The feeding unit 105 is provided between the antenna element 104 and the matching circuit unit 106. The feeding unit 105 has a function of feeding electric power to the antenna element 104.

The antenna element 104 is connected to the matching circuit unit 106 via the feeding unit 105. The antenna element 104 is branched into the first antenna element 104-1 and the second antenna element 104-2 in a direction from the feeding unit 105 toward an open end side. That is, the antenna element 104 has a 1-feed 2-branch type shape. As illustrated in FIG. 1, the first antenna element 104-1 and the second antenna element 104-2 are formed in a substantially rectangular dimension whose longer side has a length (L5) of approximately 35 mm and whose shorter side has a length (L6) of approximately 20 mm and are mounted in the third portion 113.

The first antenna element 104-1 supports the first frequency band, and the second antenna element 104-2 supports the second frequency band. In the configuration illustrated in FIG. 1, the first antenna element 104-1 is a meander element, and the second antenna element 104-2 is an inverted L-shaped element.

In the configuration illustrated in FIG. 1, the antenna element 104 has a monopole configuration made up of a meander element and an inverted L-shaped element. However, the antenna element 104 is not limited to a specific shape and a configuration, provided that the antenna element 104 operates in the first frequency band and the second frequency band.

Design of the ground conductor 102 and the ground conductor extension unit 103 in the present Embodiment 1 is described below. In the configuration illustrated in FIG. 1, the size of the ground conductor 102 and the size of the ground conductor extension unit 103 are designed in consideration of an SAR value that changes when the length of the ground conductor extension unit 103 is changed. This is specifically described with reference to FIG. 2.

Figure 2:
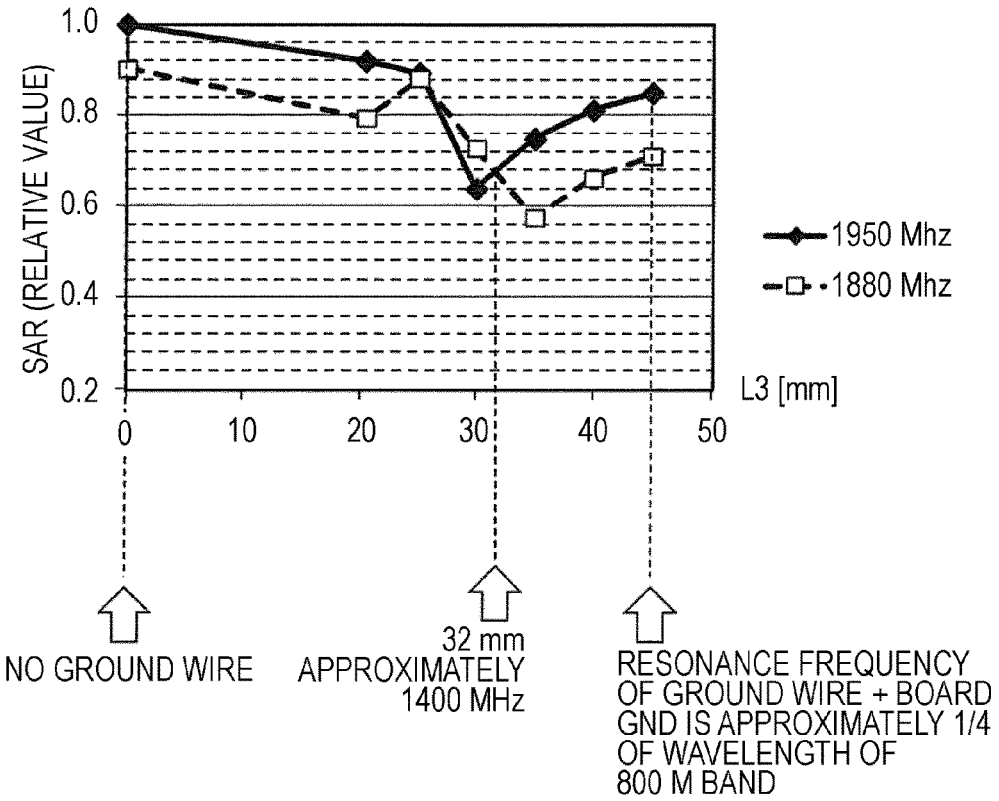
FIG. 2 is a graph illustrating an example of a relationship between the length of a longer side of a ground conductor extension unit and an SAR value in Embodiment 1 of the present disclosure.

FIG. 2 is a graph illustrating an example of a relationship between the length of the longer side of the ground conductor extension unit 103 and the SAR value in Embodiment 1 of the present disclosure. In FIG. 2, the horizontal axis represents the length (L3) of the longer side H1 of the ground conductor extension unit 103, and the vertical axis represents a relative value of the SAR value.

In the graph illustrated in FIG. 2, two graphs are illustrated as an example. The graph indicated by the solid line represents a characteristic of an SAR value obtained in a case where a frequency of 1950 MHz is used while changing the length of the ground conductor extension unit 103 in the antenna configuration illustrated in FIG. 1. The graph indicated by the dotted line represents a characteristic of an SAR value obtained in a case where a frequency of 1880 MHz is used while changing the length of the ground conductor extension unit 103 in the antenna configuration illustrated in FIG. 1.

The frequency of 1950 MHz and the frequency of 1880 MHz illustrated as examples are frequencies used for transmission in the 2 GHz band. In the present Embodiment 1, the characteristics of the SAR values at these frequencies are regarded as one index used in designing the length of the ground conductor extension unit 103.

The characteristics illustrated in FIG. 2 are normalized assuming that an SAR characteristic obtained in a case where the frequency of 1950 MHz is used in a configuration in which the length (L3) of the longer side H1 of the ground conductor extension unit 103 is 0 mm, i.e., in a configuration in which the ground conductor extension unit 103 is not provided is "1".

First, the SAR characteristic obtained in a case where the frequency of 1950 MHz is used is described. In a case where L3 changes from 0 mm to 45 mm, L3 increases and the SAR value decreases between L3=0 mm and L3=30 mm. The SAR value becomes minimum at L3=30 mm. L3 increases and the SAR value increases between L3=30 mm and L3=45 mm. That is, the SAR value has an extreme value as L3 changes.

As illustrated in FIG. 2, the SAR characteristic obtained in a case where the frequency of 1880 MHz is used also has an extreme value as in the case where the frequency of 1950 MHz is used.

As illustrated in FIG. 2, in a case where the frequency of 1950 MHz and the frequency of 1880 MHz are used, the SAR values at both of the frequencies are small in a well-balanced way at a point at which the graph of the frequency of 1950 MHz and the graph of the frequency of 1880 MHz cross each other, i.e., at L3=32 mm.

By designing the ground conductor 102 so that the length (L1) of the longitudinal side is 20 mm and designing the ground conductor extension unit 103 to have a substantially triangular shape whose longer side H1 has a length (L3) of 32 mm and whose shorter side H2 has a length (L4) of 20 mm, a wavelength of a radio wave corresponding to a resonance frequency obtained by the ground conductor 102 and the ground conductor extension unit 103 becomes ¼ of the wavelength of the frequency of 1400 MHz.

The length of a ground conductor and the length of a ground conductor extension unit are lengths equal to ¼ of the wavelength of a radio wave corresponding to a resonance frequency at which the amplitude of a high-frequency electric current distributed in the ground conductor and the ground conductor extension unit becomes maximum. The resonance frequency of the ground conductor and the ground conductor extension unit is determined by the shape and dimension of the ground conductor, the shape and dimension of the ground conductor extension unit, and a dielectric material (ABS, rubber, or the like), a magnetic material, or the like disposed around the ground conductor and the ground conductor extension unit.

That is, the ground conductor 102 and the ground conductor extension unit 103 need just be designed to have a length that is ¼ of the wavelength of 1400 MHz, which is a frequency intermediate between the first frequency band (800 MHz) and the second frequency band (2 GHz).

As illustrated in FIG. 2, the SAR values at both of the frequencies are small in a case where L3 is within a certain range. Specifically, in a case where the range between the first frequency band and the second frequency band is divided into three sections, i.e., a range closer to the first frequency band, a middle range, and a range closer to the second frequency band, the ground conductor 102 and the ground conductor extension unit 103 need just have a length that is ¼ of the wavelength of a frequency included in the middle range.

In the present Embodiment 1, the ground conductor 102 and the ground conductor extension unit 103 are designed to have a length that is ¼ of the wavelength of a frequency included in the middle range between the first frequency band and the second frequency band. In a more restrictive case, the ground conductor 102 and the ground conductor extension unit 103 are designed to have a length that is not a natural number multiple of ¼ of the wavelength of the first frequency band and that is ¼ of the wavelength of the frequency included in the middle range between the first frequency band and the second frequency band.

Alternatively, the ground conductor 102 and the ground conductor extension unit 103 may be designed to have a length that is in a range from −5% to +20% of ¼ of the wavelength of a frequency intermediate between the first frequency band and the second frequency band.

By thus designing the ground conductor 102 and the ground conductor extension unit 103, the SAR values can be made small in a well-balanced way in both of the first frequency band and the second frequency band while securing antenna performance.

Embodiment 2

In Embodiment 1 described above, the antenna device 100 is disposed in three portion, i.e., the first portion 111, the second portion 112, and the third portion 113. In the present embodiment 2, the antenna device 100 is disposed in a wristwatch-type terminal 200 that is a specific example of the portion.

Figure 3:
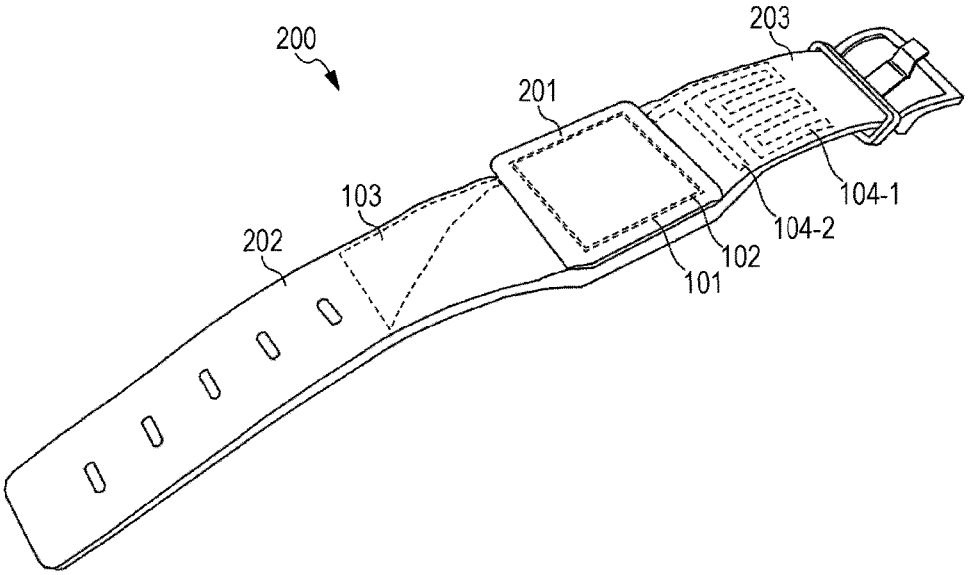
FIG. 3 is a diagram illustrating an example of a wristwatch-type terminal in Embodiment 2 of the present disclosure.
Figure 4:
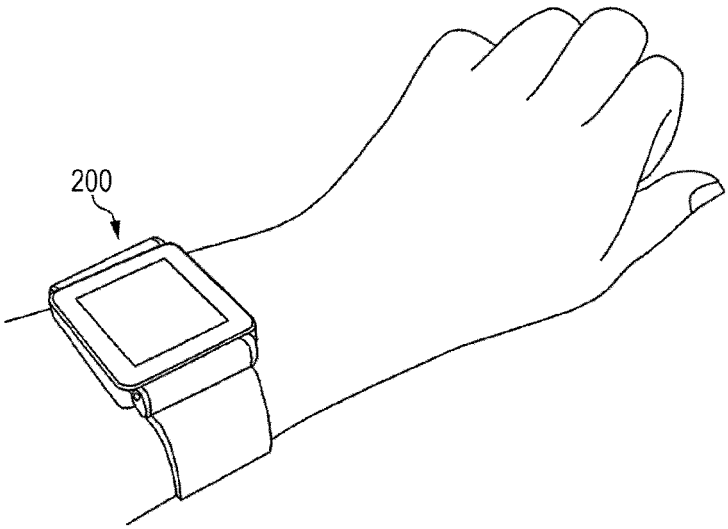
FIG. 4 is a diagram illustrating a state in which the wristwatch-type terminal illustrated in FIG. 3 is attached to a wrist.

A specific configuration in the present Embodiment 2 is described below with reference to FIGS. 3 and 4. FIG. 3 is a diagram illustrating an example of a wristwatch-type terminal 200 in Embodiment 2 of the present disclosure. FIG. 4 is a diagram illustrating a state in which the wristwatch-type terminal 200 illustrated in FIG. 3 is attached to a wrist. Note that in the present Embodiment 2, constituent elements that are identical to those in Embodiment 1 are given identical reference signs, and description thereof is omitted.

As illustrated in FIG. 3, the wristwatch-type terminal 200 includes a main body 201, a first belt unit 202, and a second belt unit 203. The main body 201 is, for example, made of a resin material such as ABS. The first belt unit 202 and the second belt unit 203 are made of a resin material such as rubber or plastic.

A circuit board 101 of an antenna device 100 is disposed in the main body 201. As in Embodiment 1, a ground conductor 102 is disposed on the circuit board 101.

A ground conductor extension unit 103 of the antenna device 100 is disposed in the first belt unit 202. Specifically, the ground conductor extension unit 103 made of a material such as a copper foil may be disposed inside the first belt unit 202. Alternatively, the resin material of the first belt unit 202 and the ground conductor extension unit 103 may be formed so as to be integral with each other.

An antenna element 104 of the antenna device 100 is disposed in the second belt unit 203. Specifically, the antenna element 104 made of a material such as a copper foil may be disposed inside the second belt unit 203. Alternatively, the resin material of the second belt unit 203 and the antenna element 104 may be formed so as to be integral with each other.

In the present Embodiment 2, a case where the antenna device 100 is applied to a small terminal such as the wristwatch-type terminal 200 has been described.

Although a case where the antenna device 100 is applied to a wristwatch-type terminal has been described in the present Embodiment 2, similar effects can be produced even in a case where the antenna device 100 is applied to a small wearable terminal such as a necklace-type terminal or an eyeglass-type terminal.

An antenna device according to the present disclosure is suitably mounted in a wearable device or the like.

What is claimed is:

1. An antenna device comprising:

a ground conductor;

a ground conductor extension that is connected to the ground conductor; and an antenna element that is connected to the ground conductor and that operates in both a first frequency band and a second frequency band higher than the first frequency band, wherein a total length of the ground conductor and the ground conductor extension is within a range from −5% to +20% of a quarter wavelength of a first frequency, wherein the first frequency is included in a middle frequency range between the first frequency band and the second frequency band, and the total length of the ground conductor and the ground conductor extension is not a natural number multiple of a quarter wavelength of a second frequency included in the first frequency band.

2. The antenna device according to claim 1, wherein the total length of the ground conductor and the ground conductor extension is equal to the quarter wavelength of the first frequency.

3. The antenna device according to claim 1, wherein the ground conductor has a substantially rectangular shape;

the antenna device further comprises:

a feeder disposed at an end of a first side of the ground conductor; and a connector disposed at an end closer to the feeder among ends of a second side of the ground conductor opposite to the first side; and the ground conductor is connected to the ground conductor extension via the connector.

4. The antenna device according to claim 1, wherein the first frequency band is a 800 MHz band; and the second frequency band is a 2 GHz band.

5. The antenna device according to claim 1, wherein the ground conductor is contained in a first portion;

the ground conductor extension is contained in a second portion; and the antenna element is contained in a third portion; wherein the first portion, the second portion, and the third portion are defined as a portions of the antenna device.

6. The antenna device according to claim 1, wherein the antenna element has a first antenna element that operates in the first frequency band and a second antenna element that operates in the second frequency band;

the first antenna element is a meander-shaped element; and the second antenna element is an inverted L-shaped element.

7. The antenna device according to claim 5, further comprising:

a main body of a wristwatch-type terminal;

a first belt that is connected to the main body and that is made of a resin; and a second belt that is connected to the main body on a side opposite to the first belt and that is made of a resin;

the first portion being the main body, the second portion being the first belt, and the third portion being the second belt.

8. The antenna device according to claim 7 wherein the ground conductor extension in the first belt has a substantially triangular shape, wherein one side of the triangular-shaped ground conductor extension is arranged in a direction of extension of the first belt.

* * * * *